US005709493A

United States Patent [19]

Kobayashi et al.

[11] Patent Number: 5,709,493

[45] Date of Patent: Jan. 20, 1998

[54] BALLPOINT PEN HAVING A BACKFLOW PREVENTING MECHANISM

[75] Inventors: Seiichi Kobayashi; Kazuhiko Furukawa, both of Yokohama, Japan

[73] Assignee: Mitsubishi Pencil Kabushiki Kaisha, Tokyo, Japan

[21] Appl. No.: 613,896

[22] Filed: Mar. 11, 1996

Related U.S. Application Data

[63] Continuation-in-part of Ser. No. 213,942, Mar. 16, 1994, abandoned.

[30] Foreign Application Priority Data

Mar. 18, 1993 [JP] Japan ..... 5-012171
May 24, 1993 [JP] Japan ..... 5-031856

[51] Int. Cl.[6] ..... B43K 7/00; B43K 7/10

[52] U.S. Cl. ..... 401/219; 401/141; 401/142; 401/209; 401/202; 401/213

[58] Field of Search ..... 401/209, 219, 401/141, 202, 213, 142

[56] References Cited

U.S. PATENT DOCUMENTS

| | | | |
|---|---|---|---|
| 3,792,932 | 2/1974 | Henriksen | 401/219 X |
| 4,911,571 | 3/1990 | Inoue et al. | 401/213 X |
| 5,127,754 | 7/1992 | Mase | 401/213 X |
| 5,348,411 | 9/1994 | Ozu et al. | 401/209 X |

FOREIGN PATENT DOCUMENTS

| | | | |
|---|---|---|---|
| 971021 | 1/1951 | France . | |
| 1056717 | 3/1954 | France . | |
| 1497176 | 10/1967 | France . | |
| 49-30035 | 6/1947 | Japan . | |
| 475661 | 2/1972 | Japan | 401/219 |
| 4-52067 | 8/1992 | Japan . | |
| 2 078 175 | 1/1982 | United Kingdom . | |
| 86/04345 | 7/1986 | WIPO . | |

*Primary Examiner*—Steven A. Bratlie
*Attorney, Agent, or Firm*—Darby & Darby

[57] ABSTRACT

A ballpoint pen for use with ink having thixotropic (shear viscosity decreasing properties) and a joint for regulating the flow of the ink to the pen's tip through an entrance in the tip. The joint includes a valve chamber which is disposed in an approximately middle portion of the joint with respect to the axial direction thereof for holding a ball therein with play and has a ball seat in the rear part thereof, a cavity in front of the valve chamber and a conduit communicating with an ink reservoir. In this arrangement, in order to allow the ball to fit on the ball seat to prevent ink from flowing backward when the ballpoint pen is oriented upward and in order to ensure an ink flow when oriented downward, the joint portion is constructed such that an axis of path holding the ball valve with play, defined by the top surfaces of the ribs formed on the peripheral wall of the valve chamber, is made eccentric to the axis of the entrance and a channel is provided by the ribs on one side of the valve chamber space for the ink to flow therethrough.

9 Claims, 11 Drawing Sheets

BALLPOINT PEN HAVING A BACKFLOW PREVENTING MECHANISM

CROSS-REFERENCE TO COPENDING APPLICATION

This is a continuation-in-part application of the prior application Ser. No. 08/213,942 filed Mar. 16, 1994 now abandoned.

FIELD OF THE INVENTION

The present invention relates to an improved ballpoint pen equipped with a back leaking preventing mechanism and in particular to a ballpoint pen which uses a thixotropic ink (having shear viscosity decreasing property) and has a relatively low ink viscosity as compared to the ink used for oil type ballpoint pens, subject to backflow of the ink, and which presents high viscosity at static state but lowers its viscosity due to the rolling of the ball as the ink flows out of the tip during writing.

BACKGROUND OF THE INVENTION

The present applicant has disclosed a back leaking preventing mechanism in Japanese Utility Model Publication Hei 4 No. 52067 in which prevention of back leaking of ink is effected by providing a valve chamber having a ball valve therein.

This disclosure provides a plastic mouthpiece made of a synthetic resin, which holds a ball in a valve chamber thereof and which is provided with a required number of projected bars so that the ball is movable within the valve chamber without being able to leave the chamber. When writing, ink flows to the tip of the pen through channels formed between the projected bars.

The plastic mouthpiece is formed by injection-molding. During molding, the projected bars are formed as an undercut, so that it is difficult to form them with high dimensional accuracy. Furthermore, it is difficult to insert the ball into the chamber without damaging the projected bars, which must be manipulated during insertion.

Moreover, another drawback arises when the pen is centrifuged during manufacturing to remove bubbles which form when the ink is filled within the pen. More specifically, when the centrifugal operation is performed, the ball is pushed toward the projected bar area by the centrifugal force so that the ball is restrained by the projected bars.

Conventional ballpoint pens can be categorized into two types, one of which is an oil type ballpoint pen that uses a high viscosity ink. The other is a water type ballpoint pen which includes silver fibers which hold the ink and an ink feeder that leads the ink from the fibers to the tip of the ballpoint pen.

Both types of the ballpoint pens have several disadvantages, but the most notable disadvantage with regard to the oil type ballpoint pen is ink-clotting due to the high viscosity of the ink used as compared to the density of the ink when writing.

In contrast, the water type ballpoint pen requires a higher cost for materials since the water type ballpoint pen uses silver fibers for retaining the ink. Additionally, the water type ballpoint pen has a drawback in that the consumption of the ink is unknown.

To overcome the disadvantages for each, a ballpoint pen which uses a thixotropic ink (having shear viscosity decreasing property) has been used which has high viscosity at a static state but which lowers its viscosity when writing due to the rolling of the ball so as to allow the ink to flow easily.

However, with regard to the ballpoint pen using such a thixotropic ink, the ink must be volatile or easy to vaporize and the ballpoint pen must be adapted such that a large amount of ink flows out in order to enhance the written density of the ink. Accordingly, the ink reservoir should be large in diameter so as to retain a large amount of ink. In addition, since the viscosity of the ink is low as compared to that used for oil-type ballpoint pens, the flow resistance of the ink to the ink reservoir is relatively small. As a result, the ink may leak backwards to the rear end of the ink reservoir due to the weight of the ink and also due to shock impacts from the exterior. There is also another problem in that the ball at the tip is subject to slippage due to shock impacts which occur when the pen is dropped.

To prevent leakage and backflow of the ink, ballpoint pens of this type are generally provided with a greasy follower at the rear of the ink reservoir which moves following the consumption of the ink used during writing. The follower prevents the vaporization of the ink as well as inhibits the back leaking of ink due to the weight of the ink or shock caused by external impact.

Even with the follower, if the ink immediately under the ball tip is used when writing with the pen upside down, the pressure of the ink is applied directly towards the rear of the pen, thus causing notable back leaking of ink.

In addition, when the inner diameter and length of the ink reservoir are increased so as to increase the amount of ink, it becomes difficult to regulate the backflow effect caused by shock impacts. Once ink leaks backward, the ink not only pollutes the barrel inside the pen but also leaks out through the vent disposed in the barrel which soils the hands and clothes of the user. The oil type ballpoint pens also suffer from the backflow effect of the ink but the effect is more apparent with ballpoint pens using ink having a thixotropic property (having shear viscosity decreasing property).

Another problem with typical ballpoint pens is the instability of the pen's tip due to a gap between the tip opening of the mouthpiece and the tip which causes the tip to raffle or sway.

In order to achieve a further improvement in safety, Japanese Utility Application Laid-Open Sho 49 No. 30035 discloses a follower with a cup-shaped float immersed therein. A typical follower not only reduces backflow, but also serves to inform the user when the ink reservoir has been depleted. Therefore, it is preferable that the follower be a particular color. However, if a dye is used that is compatible with or soluble in the ink, it becomes difficult to keep a clear separation between the follower and the end of the ink. In addition, the follower may flow into the tip portion, causing deterioration of the pen's writing performance.

A typical ballpoint pen using a thixotropic ink employs a cap having a resilient, non-absorptive sealing piece made of a closed foam material which is pressed against the ball tip when the pen is not being used. In general, the front barrel end of the pen is covered with the resilient cap so as to hermetically seal the tip end. If the cap has no ventilating means, pressure inside the cap could increase upon placement of the cap on the ball tip. Part of the pressurized air is forced into the ink through a slight clearance between the ball and the tip holding the ball. The air that flows accumulates as air bubbles in the ink due to the blockage by the follower. These air bubbles inhibit the ink from flowing smoothly when writing. To deal with this, a ventilating means is provided between the pen tip and the cap to prevent the above effect, but this results in unwanted vaporization of the ink.

SUMMARY OF THE INVENTION

Accordingly, it is a first object of the present invention to provide an improved ballpoint pen which is equipped with a backflow preventing mechanism for preventing ink backflow caused when the ballpoint pen is used with the pen upside down or when the pen is shocked, and which is free from the disadvantages of conventional backflow preventing mechanisms and in which slippage of the ball tip due to falling impacts is prevented.

A second object of the present invention is to provide a ballpoint pen in which shaking or swaying movement of the tip is prevented even if there is a clearance between the tip opening of the mouthpiece and the tip, so as to achieve stability of the pen's tip when writing.

A third object of the present invention is to provide an improvement of a ballpoint pen using a thixotropic ink (having shear viscosity decreasing property) which presents high viscosity at static state but lowers its viscosity, due to the rolling of a ball when writing, to allow the ink to flow easily. To accomplish this, a ballpoint pen is provided having an increased ink reserve by making an ink reservoir greater in diameter and/or length so as to increase the life of the pen.

A fourth object of the present invention is to provide a ballpoint pen having an improved refill, wherein the filled refills and ink follower are bundled and undergo a centrifugal operation so as to remove air bubbles in the ink. The centrifugal operation allows the ink to be de-foamed such that the bundle of all the refills may be abutted at their tip ends against an abutting surface inside a container of a centrifugal separator.

A fifth object of the present invention is to provide a ballpoint pen capable of indicating the level of ink remaining in the ink reservoir without affecting the writing performance.

A sixth object of the present invention is to provide a ballpoint pen which can regulate the pressure inside the pen when a cap is attached so as not to prevent air from flowing into the ink and which can prevent the vaporization of the ink by simple means.

A seventh object of the present invention is to provide a ballpoint pen which allows air to pass through the pen's cap thus preventing the possibility of choking in the event that an infant accidentally swallowed the cap and the cap stuck in the infant's throat.

A ballpoint pen is equipped with a back leaking preventing mechanism and comprises a joint, which comprises a valve chamber disposed in an approximately middle portion of the joint with respect to the axial direction thereof for holding a ball valve therein with play, the valve chamber further having a ball valve seat in a rear portion thereof; a cavity having an entrance disposed in front of the valve chamber; and a conduit disposed in the rear portion of the valve chamber and communicating therewith via the ball valve seat, the joint holding a tip in the cavity and holding an ink reservoir communicating with the conduit; and means which allows the ball valve to fit on the ball valve seat so as to block the conduit when the cavity is oriented upward and which allows the ball valve to be spaced from a wall surface of the valve chamber and be held so as not to block the entrance of said cavity when said cavity is oriented downward. The means is constructed such that an axis of path holding the ball valve with play is made eccentric relative to the axis of the entrance wherein a channel is provided on one side of the valve chamber.

DETAILED DESCRIPTION OF THE INVENTION

Figure 1:
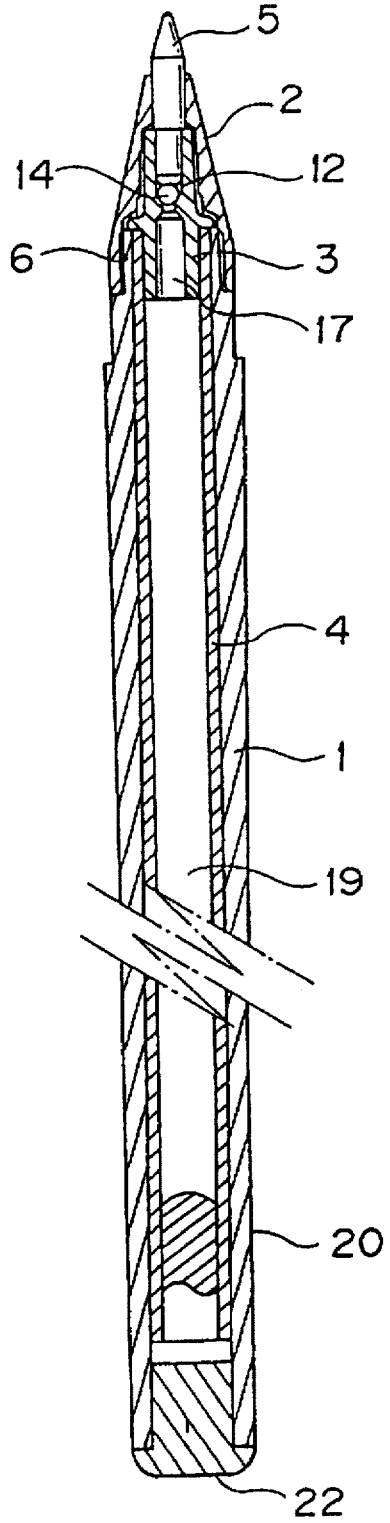
FIG. 1 is a vertical cross-section of a ballpoint pen in the preferred embodiment of the present invention with the tip oriented upward.

Referring to FIGS. 1–6, a preferred ballpoint pen of the present invention includes a joint 3 which defines a ball valve seat 13 oriented in an axial direction. The ball valve seat 13 comprises one end of a conduit 17 which communicates with an ink reservoir 4. The joint 3 also defines a valve chamber 12 in which a movable ball valve 14 is inserted in a cavity 10 in the front part of the valve chamber 12. In this structure, when the cavity 10 is oriented upward (FIG. 2), the ball valve 14 engages the ball valve seat 13 so as to block the conduit 17 thereby preventing the ink from flowing back into the ink reservoir 4. In contrast, the joint 3 further includes means for preventing the ball valve 14 from blocking the entrance 10*a* of the tip 5 which is preferably press-fitted into the cavity 10 when the cavity 10 is oriented downward. The joint 3 is preferably integrally molded of an elastically deformable synthetic resin and defines a valve chamber 12 behind the cavity 10, communicating therewith.

One of such means can be constructed so that the conduit 17 of the ball valve seat 13 that communicates with the ink reservoir 4 is disposed eccentrically relative to the entrance 10*a* of the tip 5 but the valve chamber 12 is formed within a range of the inside circumference of the cavity 10. The eccentricity "S" is represented by an interval between a central axis 33 of the tip end 18 and a central axis 34 of the conduit 17.

Referring to FIGS. 2–6, the axis of the entrance 10*a* can be made coincident with that of the cavity 10 while the central axis 34 of the conduit 17 communicating with the ink reservoir 4 is made eccentric to the central axis 33 of the entrance 10*a*. Alternatively, the central axis 34 of the conduit 17 can be made coincident with that of the ballpoint pen while the entrance 10*a* is disposed eccentrically relative to the cavity 10.

The aforementioned means that prevents the ball valve 14 from blocking the entrance 10*a* of the tip 5 includes all these configurations.

Still another alternate embodiment is shown in FIGS. 10 to 13. Here, the axis 34 of the conduit 17 is made coincident with that of the entrance 10*a* while preferably a plurality of vertical ribs 15*a* each having a different height are disposed along the peripheral wall of the valve chamber 12. The ribs 15*a* are provided such that a cylindrical space may be created by the top surfaces of the ribs 15*a* and the axis 34 of the thus formed cylindrical space is made eccentric to the axis 33 of the entrance 10*a*. A movable ball valve 14 which has a spherical shape at least on the surface that contacts the conduit is inserted into the thus formed cylindrical space.

Figure 12:
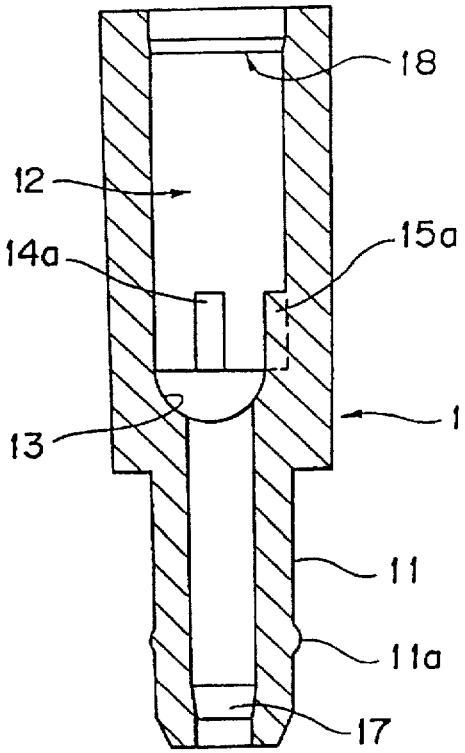
FIG. 12 is an enlarged vertical cross-sectional view showing a joint of the ballpoint pen in an alternate embodiment of the present invention.
Figure 13:
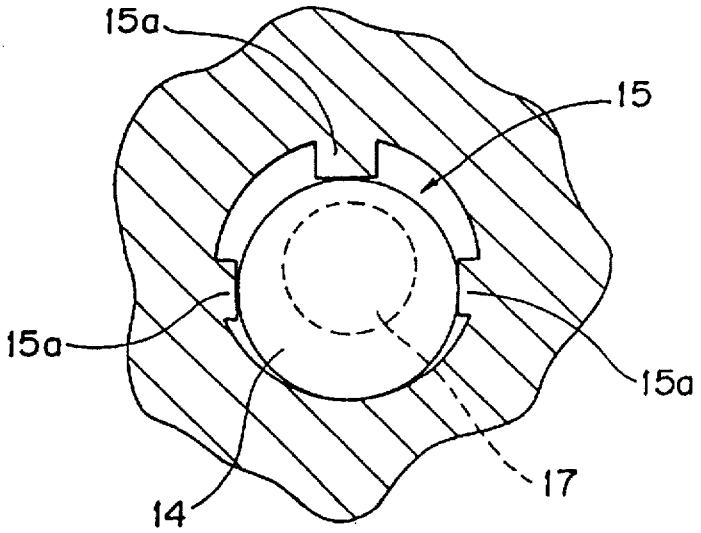
FIG. 13 is a horizontal cross-sectional view taken along line A—A of FIG. 10 of the ballpoint pen in an alternate embodiment of the present.

In this case, the axis of the ball valve 14 placed on the opening to the conduit 17 is made eccentric to the axis 34 of the conduit 17. The ball valve 14 may be structured as a hemispheric form with a projection 14*a* on the plane side as shown in FIG. 12. Here, the projection 14*a* must be long enough to keep the hemispheric portion of the valve 14 to orient towards the conduit 17 and must be shaped so as not to block the entrance 10*a*. This hemispheric structure makes it possible to limit the length of the vertical ribs 15*a* in the valve chamber 12 to the vicinity of the ball valve seat 13.

Of these means, the preferred embodiment is shown in FIGS. 2–6 and will be hereinafter described in detail.

In the preferred embodiment, the axis of the conduit 17 of the ball valve seat 13 that communicates with the ink reservoir 4 is eccentric to the axis 33 of the cavity 10 while the valve chamber 12 is made to stay within a range of the inside circumference of the cavity 10. Accordingly, when the ballpoint pen is oriented upward or with the ball valve 14 engaging the ball valve seat 13, the center of the ball valve 14 is slightly eccentric from the axis 33 of the cavity 10 to form a channel 15 on one side of the valve chamber 12.

The channel 15 allows the idly held ball 14 in the valve chamber 12 to abut the tip end 18 eccentrically when the pen is in a writing position (with the tip downward) to create an ink passage. This passage communicates from the ink reservoir 4 through the conduit 17 and channel 15 to the tip 5, thus supplying ink to the tip end 5*a*.

The joint 3 is mainly composed of a tapered pipe portion 7, a flange 16 and a fitted pipe portion 11. A plurality of tapered vertical ribs 8 are extended along the length of the tapered pipe portion 7 to the flange 16. These vertical ribs 8 engage an inner step portion of a mouthpiece 2 when the mouthpiece 2 threadably engages a barrel 1 to prevent the tip 5 from swaying when writing.

The ink reservoir 4 is filled with ink having thixotropic properties, and a follower 20 that moves following the consumption of the ink, is provided at the rear of the ink reservoir 4 to prevent vaporization of the ink.

In this case, the follower, composed of a transparent or translucent greasy material, is inserted over the ink with a colored resin piece immersed therein having a specific weight approximately equal to that of the follower, so that the remaining amount of ink can be clearly seen and the ball tip can be prevented from disengaging the tip upon impact, when dropped. The flange 16 is provided in an annular form at the rear end of the tapered pipe portion 7 in the joint so that the front end of the barrel 1 is abutted against the rear side of the annular flange 16. The ribs 8 are formed with linearly or curvingly slanting surfaces and provided on the outside surface of the tapered pipe portion 7, while rear ends of the ribs 8 are connected with the flange 16, level with the outside diameter surface of the flange 16. The mouthpiece 2 is fixed to the barrel 1 with the inner step portion of the mouthpiece being connected to the peripheral portions of the ribs 8. Further, there is provided a ventilating passage communicating from the tip 5 to an inner space 1*a* (FIG. 8) inside the barrel 1. More specifically, the ventilating passage is formed from a clearance at the front opening of the mouthpiece 2 and the tip 5, which is penetrated therethrough. The ventilating passage is communicated by way of channels defined between the ribs 8 disposed on the peripheral surface of the tapered pipe portion 7 and the inner surface of the mouthpiece 2 and by way of recesses 6*a* formed at the front barrel end to the inner space 1*a* inside the barrel 1. In addition, a cap 23 which is attached to the front barrel 1 is integrally formed with an inner cap 25 for hermetically covering the tip portion in a relatively small space.

Formed across the cap 23 and the inner cap 25 is a vent which communicates from the inserting side to the rear end of the cap 23. The inner cap 25 is further provided with a resilient, non-absorptive sealing piece 28 made of a closed air-foam material for engaging the tip end 5*a*.

The present invention will be hereinafter described more specifically with reference to the embodiments of FIGS. 1–6, but the following examples are not intended to limit the present invention.

Preferably, the principal surface of the valve chamber 12 is defined eccentrically to the axis of the cavity 10 with the valve chamber 12 being contained within a range of the inner periphery of the cavity 10. Further, the valve chamber 12 includes a ball valve seat 13 at the rear part thereof while the axis of the hole of the ball valve seat 13 is made eccentric at the distance "S" relative to the axis of the cavity 10. Moreover, a channel 15 is provided on one side of the valve chamber 12.

A ball valve 14 is inserted inside the valve chamber 12. Formed in the center portion of the ball valve seat 13 is a conduit 17 which communicates with the ink reservoir 4 disposed therebehind.

The flange 16 is provided at the rear end of the tapered pipe portion 7 and the fitting pipe portion 11 is extended backward from the rear side of the flange 16.

The cylindrical ink reservoir 4 is secured to the outside periphery of the fitting pipe portion 11 in such a manner that the front end of the reservoir 4 abuts the rear side of the flange 16 while the inner portion of the ink reservoir 4 communicates with the conduit 17 of the joint 3. Filled inside the ink reservoir 4 is thixotropic ink 19 (having shear viscosity decreasing property) which presents high viscosity at static state but lowers its viscosity to provide easier flow of the ink due to the rolling of the ball 5*a* during writing (FIG. 1). Filled at the rear of the ink 19 is a greasy follower 20, which is in contact with the ink surface for preventing the ink from vaporizing, and moves as the ink decreases. It should also be noted that the ink reservoir 4 is formed of a transparent polypropylene resin molding or the like which inhibits vaporization of ink.

The joint 3 securely joins the tip 5 with the ink reservoir 4 full of ink to form a writing portion. The thus formed writing portion is inserted into the barrel 1 from the front end thereof until the rear side of the flange 16 of the joint 3 abuts the front side of the barrel end 6. Thereafter, the mouthpiece 2 is threadably engaged into the barrel end 6 of the barrel 1 with vertical ribs 8 of the tapered pipe portion 7 being in contact with the inner step portion 9 of the mouthpiece 2. Further, one or more vents are provided on the barrel 1 for communicating with the inner space 1*a* of the barrel 1.

In an alternate embodiment, a vent (not shown) in communication with the inner barrel is provided with a plug 22 inserted at the rear end of the barrel 1.

Figure 6:
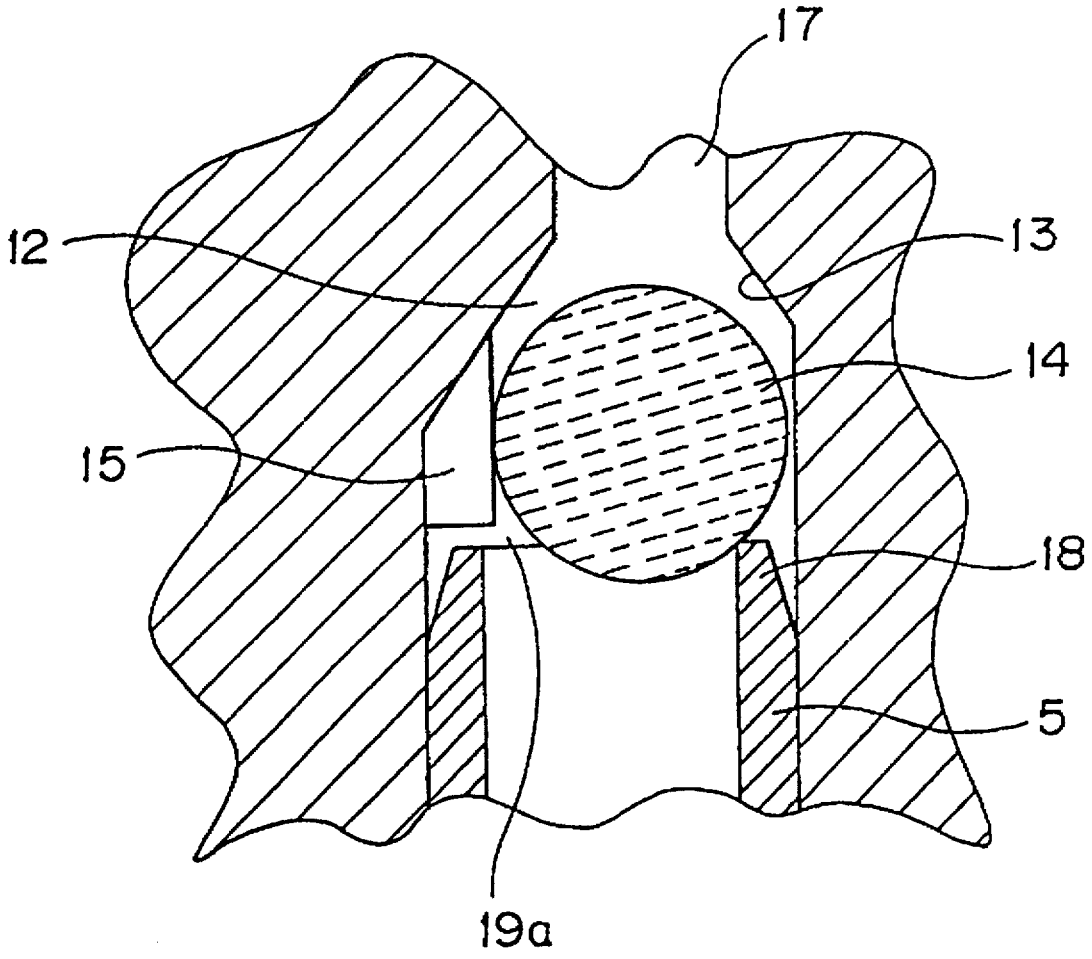
FIG. 6 is an enlarged cross-sectional view of the valve chamber portion of the preferred embodiment when the tip is oriented downward.

Referring to FIG. 6, in a downward orientation, the ball 14 abuts the tip end 18 with an off set to one side. Accordingly, a channel is provided which allows the ink to flow into the tip 5, e.g. an ink flowing passage 19*a* is formed on the other side. Ink is supplied from the ink reservoir 4 through the conduit 17 to the valve chamber 12. The ink in the valve chamber 12 further passes through the channel 15 and the ink flowing passage 19*a* and is led to the front end of the tip 5. The ink presents a high viscosity at static state, but the viscosity of the ink is lowered by the rolling of the ball at the end of the tip 5 so as to allow a relatively large amount of ink to flow out. Accordingly, it is possible to perform high density writing which is free from blotting.

Figure 2:
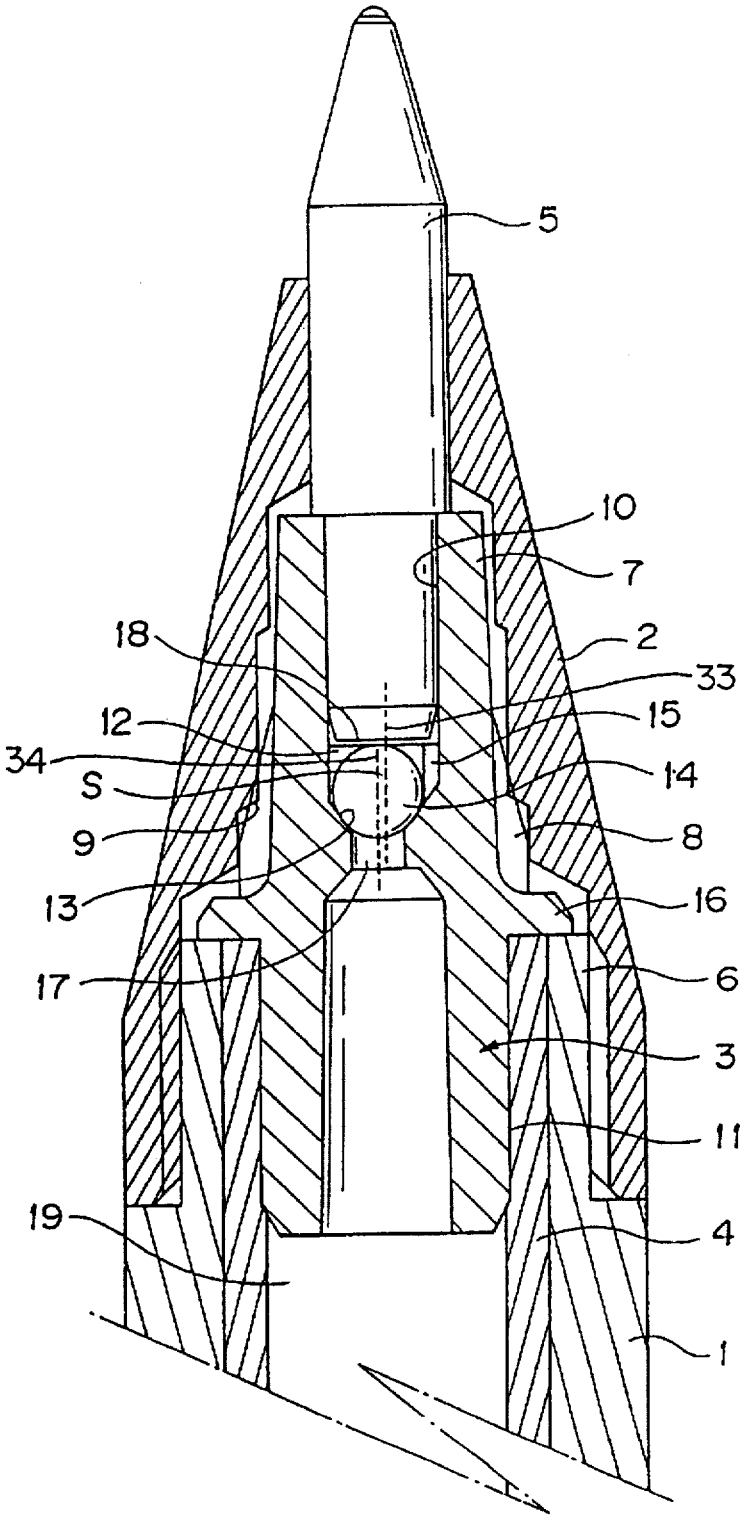
FIG. 2 is an enlarged vertical cross-section partially showing the tip portion of the ballpoint pen of the preferred embodiment with the tip oriented upward and in which the axis of the ball valve seat is disposed eccentrically to the axis of an entrance 10*a* with a channel being provided on one side of a valve chamber hole.
Figure 3:
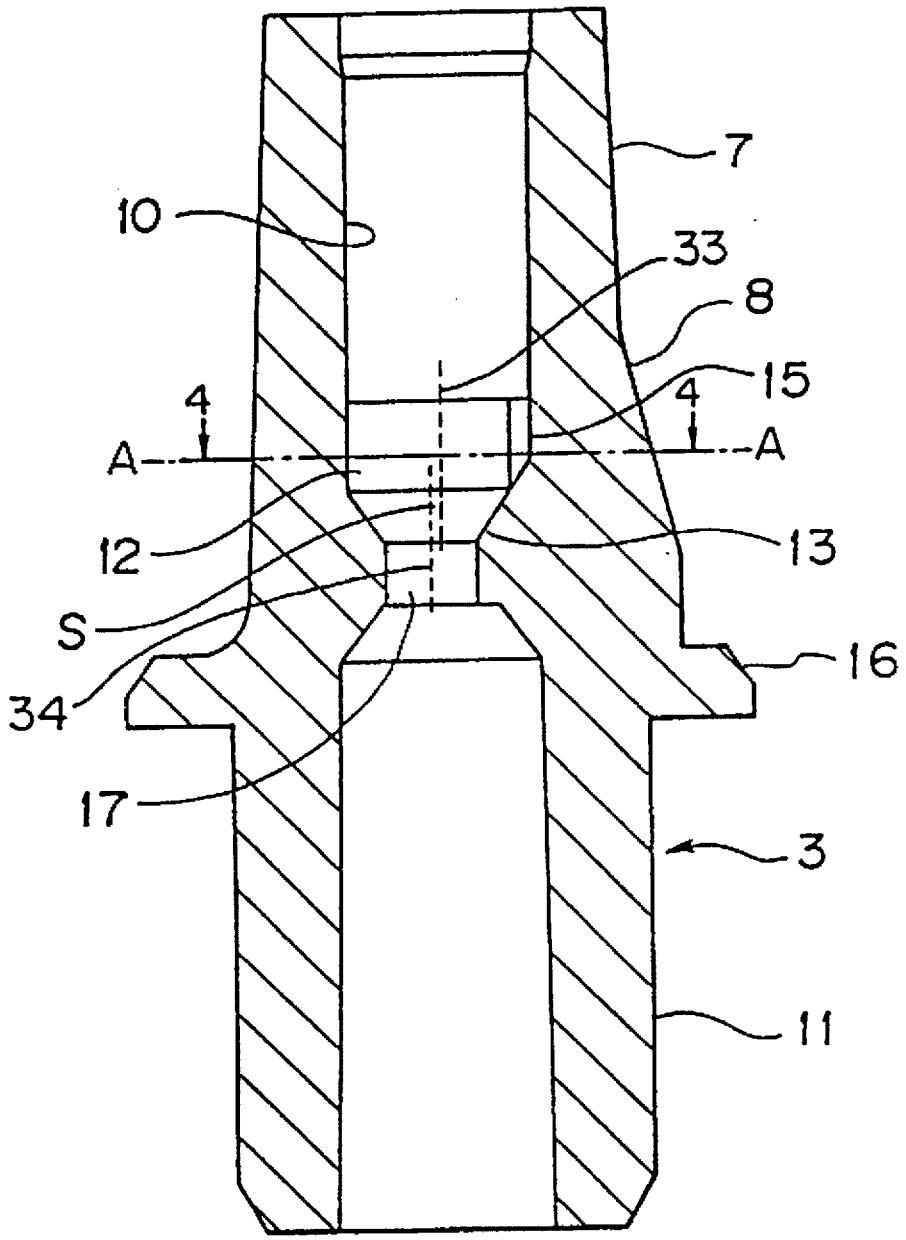
FIG. 3 is a sectional view showing the joint used in the preferred embodiment of the present invention.
Figure 4:
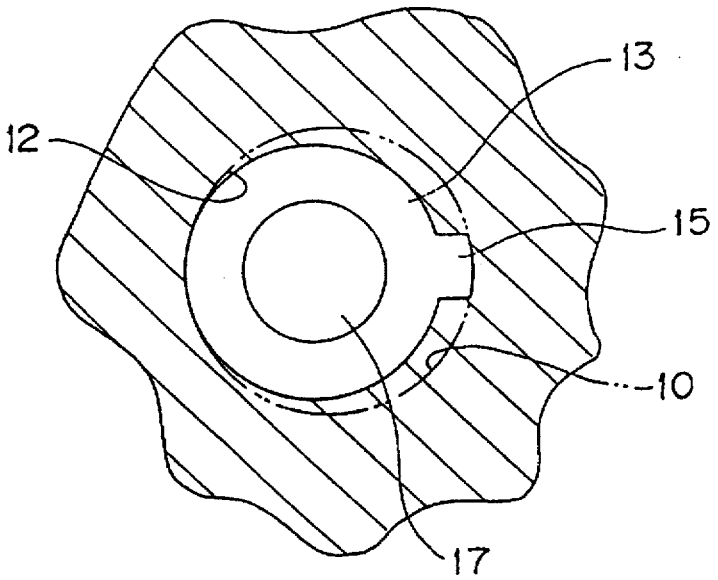
FIG. 4 is a cross-sectional view of the joint taken along line A—A of FIG. 3.
Figure 5:
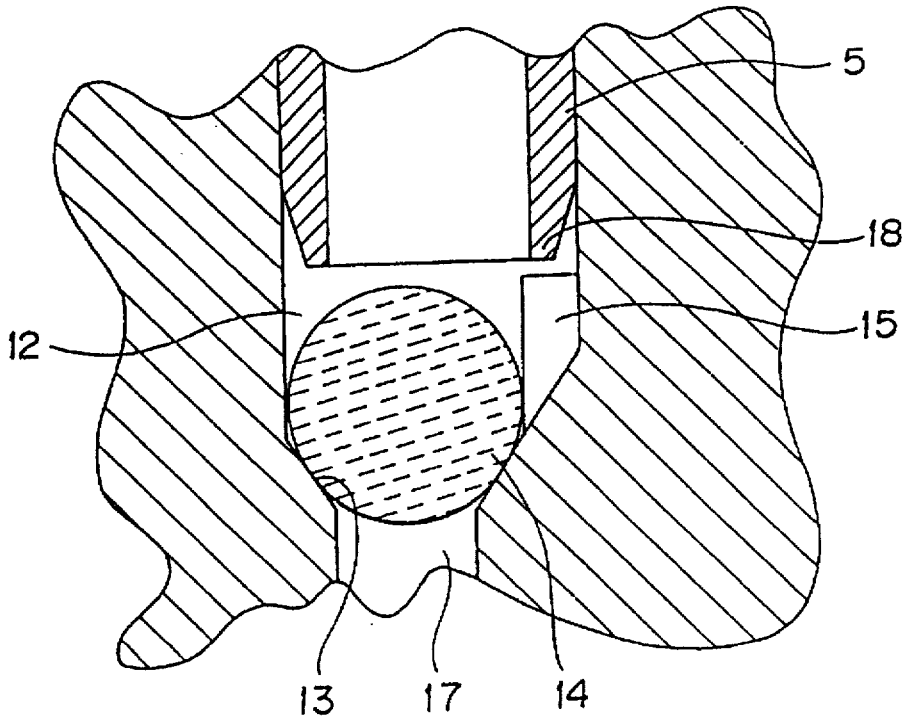
FIG. 5 is an enlarged cross-sectional view of the valve chamber portion of the preferred embodiment when the tip is oriented upward.

FIGS. 2 and 5 show a state in which the tip 5 is oriented upward. In this state, the ball 14 is placed on the ball valve seat 13 of the valve chamber 12 to block the conduit 17. Accordingly, even when the ink immediately under the ball of the tip is exhausted by writing in the upside-down position, no force acts on the ink and therefore no back leaking occurs. In addition, in the present invention, since the tip 5 is inserted into the cavity 10 of the tapered pipe portion 7 in the joint 3 while the inner step portion 9 of the mouthpiece 2 abuts or is brought into contact with the vertical ribs 8, the tip 5 is prevented from moving or swaying relative to the mouthpiece 2.

Figure 7:
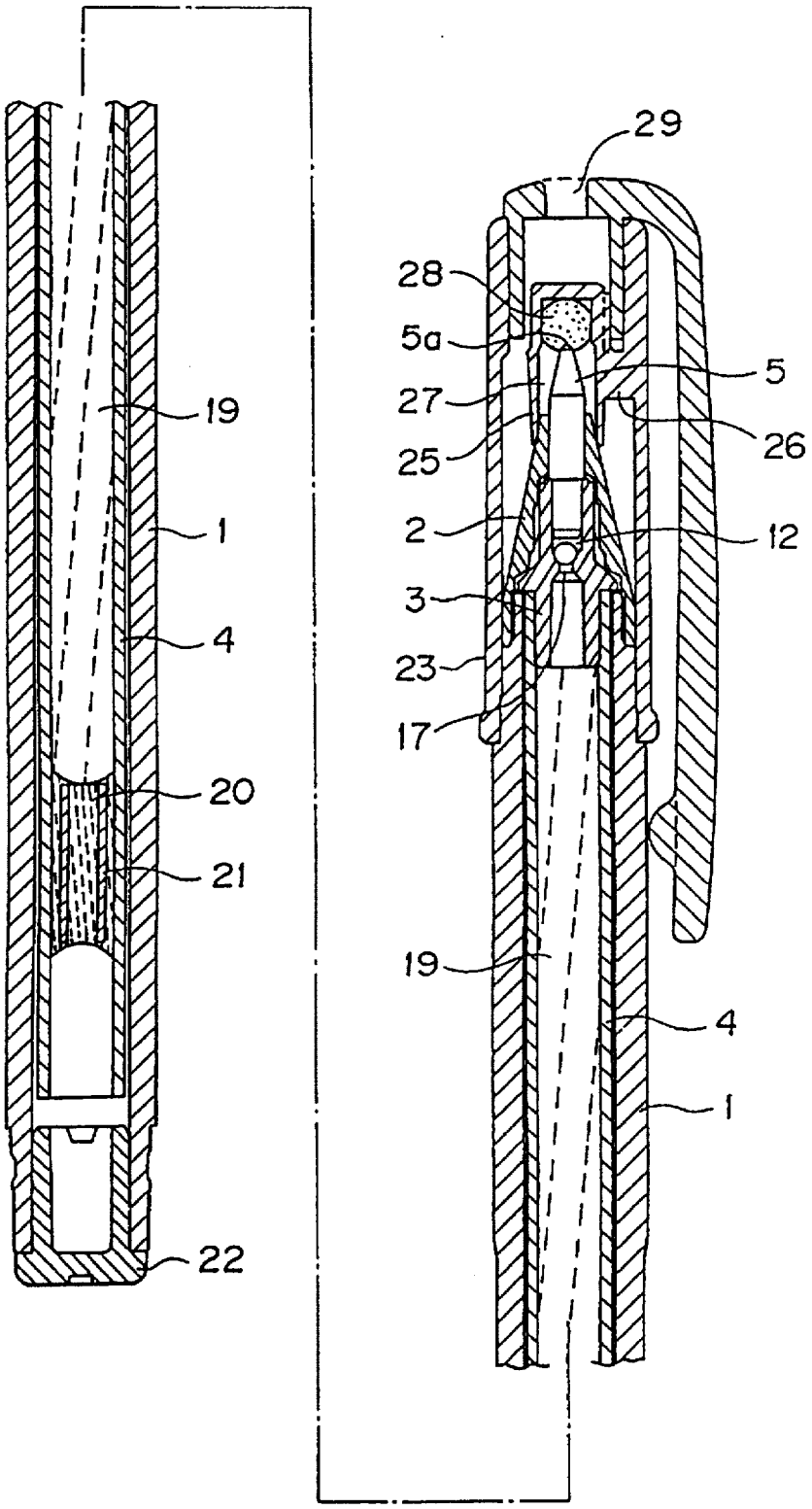
FIG. 7 is a vertical cross-sectional view of a ballpoint pen of an alternate embodiment of the present invention having a cap and a resin ring, which is immersed in the follower.
Figure 8:
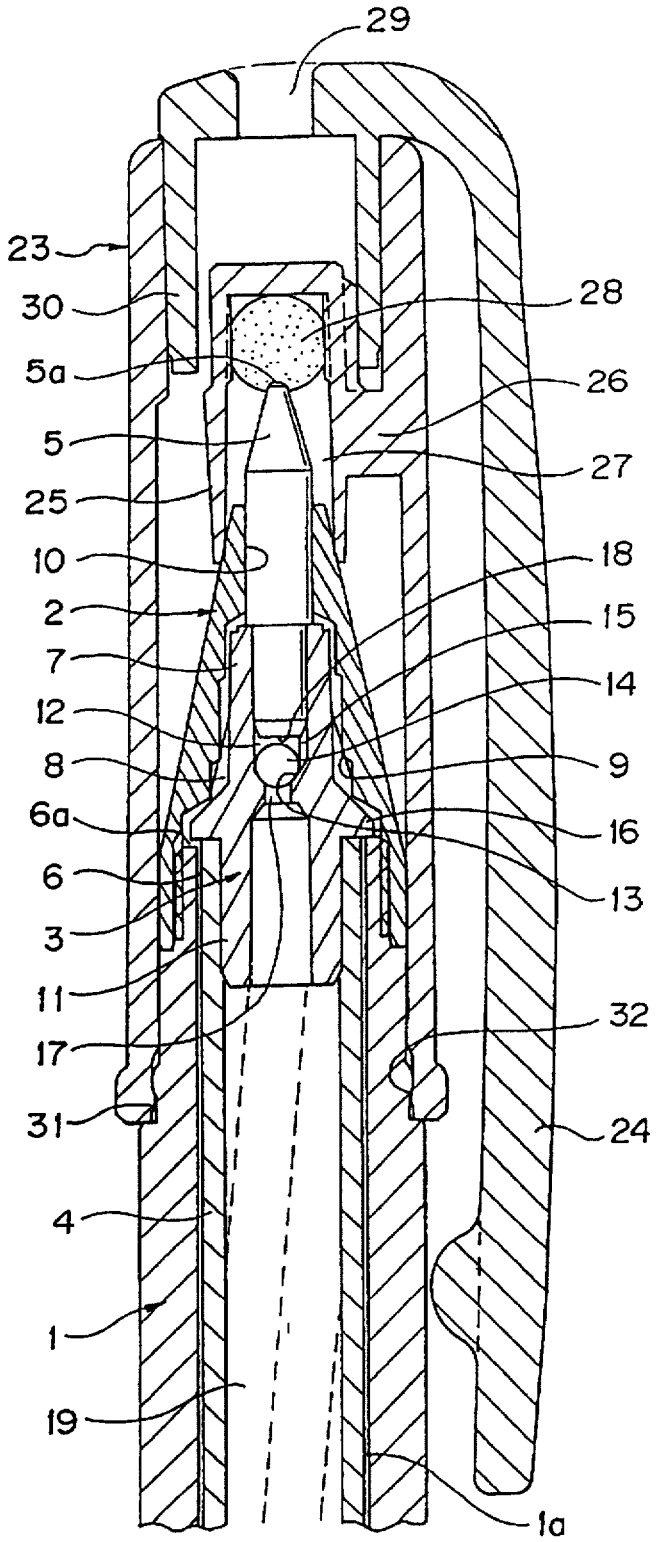
FIG. 8 is an enlarged vertical cross-sectional view of the upper portion of the embodiment of FIG. 7.
Figure 9:
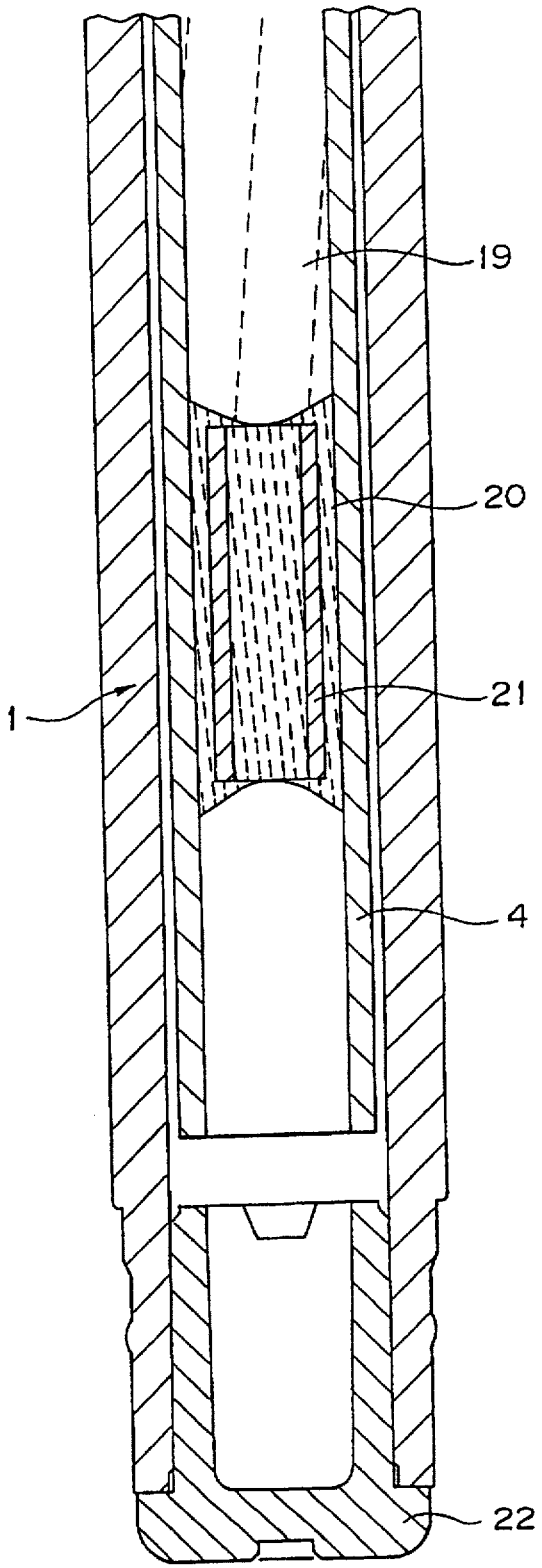
FIG. 9 is an enlarged vertical cross-sectional view of the lower portion of the embodiment of FIG. 7.

Referring to FIGS. 7–9, a front half portion of a joint 3 is composed of a tapered pipe portion 7 which is provided with linear or curved ribs 8. An annular flange 16 is formed at the rear side of the ribs 8 in such a manner that the rear ends of ribs 8 are substantially level with the outside surface of the flange 16. The joint 3 includes a tapered pipe portion 7 as a rear half part thereof and an ink reservoir 4 is secured to the fitting pipe portion 11. Inserted into a cavity 10 disposed at the front end of the tapered pipe portion 7 is a rear end of a tip 5 that holds the tip ball 5*a*.

The joint 3 is integrally molded of an elastically deformable synthetic resin and defines the valve chamber 12 behind the cavity 10 communicating thereto. Provided in the rear part of the valve chamber 12 is a frustum-shaped ball-valve seat 13. The principal surface of the valve chamber 12 is defined eccentrically to the axis of the cavity 10 with the valve chamber 12 being contained within a range of the inner periphery of the cavity 10. Further, the axis of a hole in the valve chamber 12 is made eccentric relative to the axis of the cavity 10. A channel 15 is provided on one side of the valve chamber space. A movable ball valve 14 is positioned inside the valve chamber 12. Formed in the rear part of the valve chamber 12 is a conduit 17 which communicates with the ball valve seat 13. Meanwhile, if the entrance 10*a* of the tip is disposed eccentrically relative to the cavity 10, the valve chamber 12 is not necessarily made eccentric.

The flange 16 is provided on the rear side of the tapered pipe portion 7 and the fitting pipe portion 11 is extended backward from the rear side of the flange 16.

The cylindrical ink reservoir 4 is secured to the outside periphery of the fitting pipe portion 11 such that the front end of the reservoir 4 abuts the rear side of the flange 16 while the inner portion of the ink reservoir 4 communicates with the conduit 17 of the joint 3. The ink reservoir 4 is filled with thixotropic ink 19 (having shear viscosity decreasing property) which presents high viscosity at static state but lowers its viscosity to provide easy flow of ink due to the rolling of the tip ball at writing. Moreover, inserted at the rear of the ink 19 is a transparent or translucent greasy follower 20 which is in contact with the ink surface and moves as the ink decreases for preventing the ink from vaporizing. A colored resin piece having a specific weight approximately equal to that of the follower is immersed in the follower 20. In this embodiment, the colored resin piece is a pipe piece 21, composed of PP resin or the like, which is immersed in the follower 20.

Alternatively, the pipe piece 21 is positioned such that a rear part of the pipe piece 21 projects over the rear end of the follower 20. Here, the colored resin piece is not limited to the pipe piece but may be replaced with a rod piece or ball which has an outside diameter smaller than the inner diameter of the ink reservoir 4 and is immersed in the follower. Here, it is should be noted that the ink reservoir 4 is formed of a transparent PP resin molding and the like which inhibits vaporization of ink. The thus composed arrangement of the tip 5, joint 3 and ink reservoir 4 forms a refill of the ballpoint pen.

The rear end of the barrel 1 is attached with a plug 22. The thus formed refill of the tip 5 and the ink reservoir 4 secured together by the joint 3 with the reservoir 4 filled with ink is inserted into the barrel 1 from the front end thereof until the rear side of the flange 16 of the joint 3 abuts the front side of the barrel end 6. Then the mouthpiece 2 is threadably engaged into the barrel end 6 of the barrel 1 where linear or curved ribs 8, disposed on the tapered pipe portion 7, are in contact with the inner step portion 9 of the mouthpiece 2. Here, the front side of the barrel end 6 is provided with recesses 6*a* and is abutted by the rear end of the flange 16 of the joint 3. The barrel 1 is formed of a transparent resin molding so that the consumption of ink can be seen. In this arrangement, a ventilating passage from the clearance at the front opening of the mouthpiece between the tip 5 penetrated therethrough and the opening edge is formed so as to be introduced through channels between the ribs 8, disposed on the tapered pipe portion 7 and the inner surface of the mouthpiece 2, and recesses 6*a* formed at the front side of the barrel end 6 to the inner space 1*a* inside the barrel 1. Further, vents are provided, as required, on a side surface of the barrel 1, on the plug 22 or between the plug 22 and the barrel 1, to communicate between the inner space la and the outside atmosphere.

Meanwhile, a cap 23 that covers the front barrel includes a clip 24 on the outer peripheral side thereof. This clip 24 is fixed to the cap 23 by press-fitting the cylindrical portion 30 disposed at the rear of the clip into an entrance 23*a* of the cap 23. A vent 29 penetrates through the rear end of the cylindrical portion 30. In a deeper part of the inner hollow of the cap 23 there is provided a cylindrical inner cap 25 defining a small space 27. This inner cap 25 is integrally formed with the cap 23 using a required number of ribs 26 held by the inner surface of the cap 23. By the arrangement, a ventilating passage can be formed through the channels between the ribs from the cap insert opening to the vent 29. It should be noted that formation of ventilation can be carried out by various methods and is not limited to the above particular structure.

An engaging portion 32 is disposed around the insert opening of the cap 23 and is detachably engaged with another engaging portion 31 disposed on the barrel 1. Here, this engagement is constructed in a conventional manner such as a snap-fit engagement between projection and recess. At the front end of the small space 27 of the inner cap 25 there is fixed a resilient, non-absorptive sealing piece 28 made of a closed foam material, so that the tip ball 5*a* engages the sealing piece 28 while the tip 5 and the mouthpiece 2 are hermetically confined in the small space 27.

Figure 10:
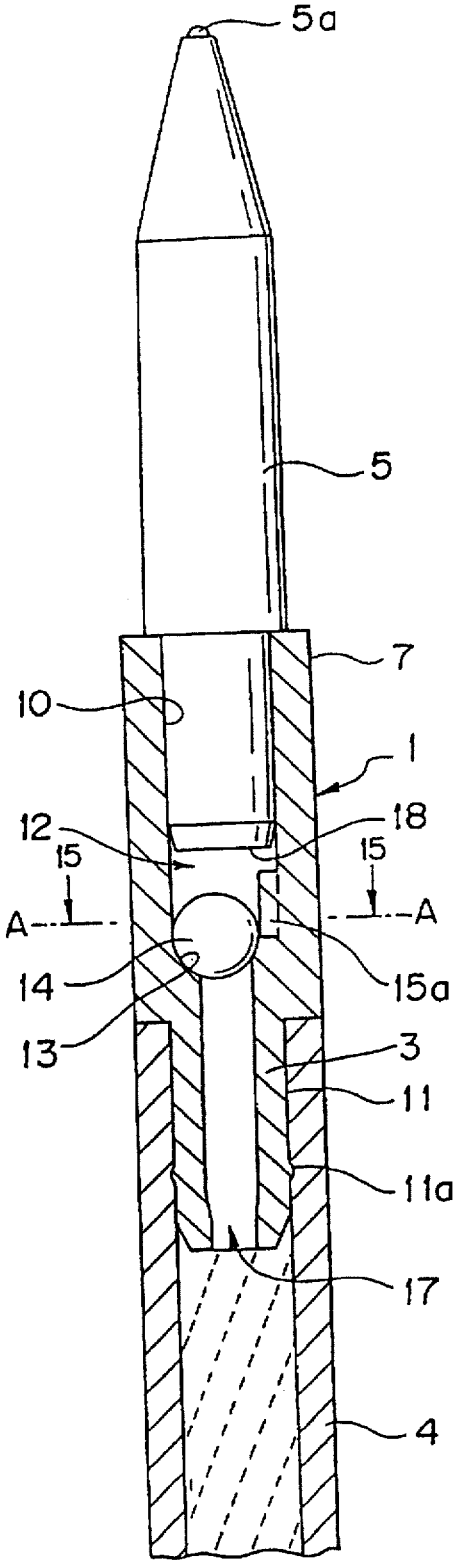
FIG. 10 is a vertical cross-sectional view partially showing a tip of a ballpoint pen with the tip oriented upward in an alternate embodiment of the present invention.
Figure 11:
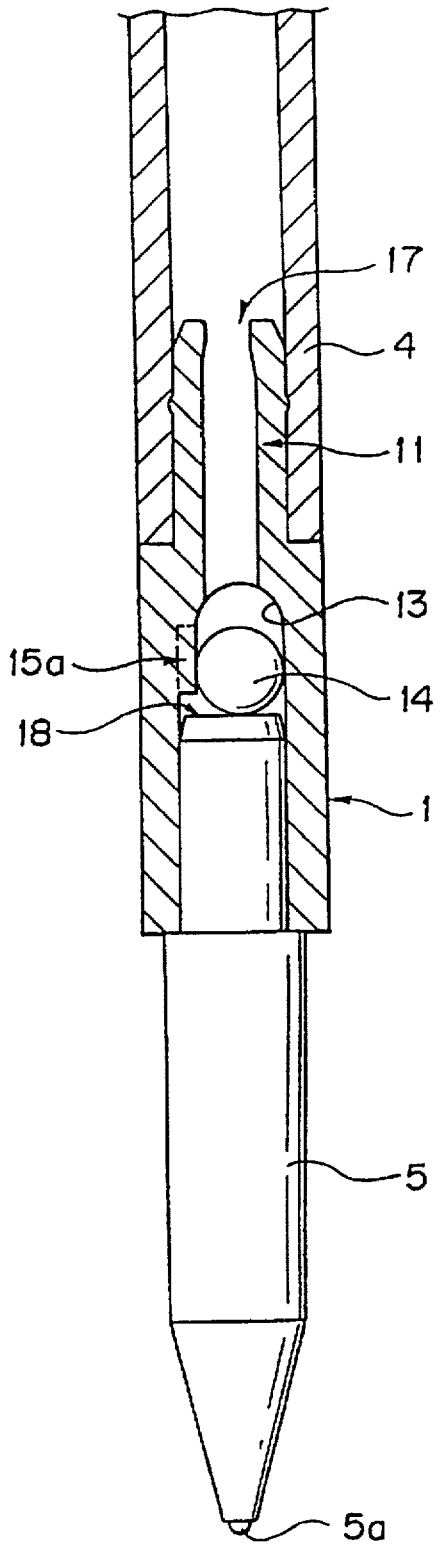
FIG. 11 is a vertical cross-sectional view partially showing the tip of the ballpoint pen with the tip oriented downward in an alternate embodiment of the present.

In the preferred embodiment, since the ball valve 14 comes into annular contact with the ball valve seat 13 in the valve chamber 12 to seal the conduit 17 as shown in FIG. 10 when the tip 5 is oriented upward, it is possible to prevent the ink from flowing backward in the state of upside-down writing. Since, as shown in FIG. 10 where the front barrel is capped by the cap 23, the front end of the tip 5 abuts the sealing piece 28 which prevents the ball 5*a* from slipping out upon impact. Additionally, since the ball valve 14 is inserted with play in the valve chamber 12 so as to be made eccentric to the entrance 18, the ball valve will not engage into the entrance when the refill is subjected to centrifugal separation upon manufacture. For the same reason, if the ball valve 14 abuts the tip end portion 18, the ball valve is set off the center so that the ink flow through the channel into the tip 5 can be established. Further, since the colored resin piece is immersed in the follower 20, not only can the exhaustion of ink be clearly seen, but also the total inner friction is increased even if the flow resistance of the follower lowers as compared to the system without a resin piece. Accordingly, the preferred pen is more reliable against back leaking and impactive pressurization on the tip ball 5*a* caused by shocks can be reduced, thus preventing the tip ball 5*a* from dislodging even when the cap 23 is not in place. Since the tip ball 5*a* is hermetically confined by the inner cap 25, it is possible to prevent the tip ball 5*a* from drying as well as preventing the ink from vaporizing. On the other hand, since the air passage is established from the tip opening of the mouthpiece 2 to the inner space 1*a* inside the barrel 1, the pressure inside the barrel due to attachment or removal of the cap can be relieved so that it is possible to prevent the problem of air bubbles flowing into the ink. Moreover, in case a small child accidentally swallowed the cap, the vent 29 would allow the child to breathe. Since the outside surface of the ribs 8 formed on the tapered pipe portion 7 in the joint 3 are brought contact with the inner step portion 9 of the mouthpiece 2, movement or swaying of the tip 5 relative to the mouthpiece 2 can be prevented.

Configurations and operations of the ballpoint pen according to the present invention have been described heretofore. In the present invention, since, by providing a valve chamber for an intermediate portion communicating between a tip and an ink reservoir 4, the ink reservoir 4 is adapted to be separated from the valve chamber by a ball inserted with play inside the valve chamber when the tip of the ballpoint pen is oriented upward during writing, ink can be prevented from leaking backward so that it is possible to avoid accidents such as polluting the barrel, hands, clothes and the like. In addition, since no undercut projection for preventing the ball from slipping out is formed in the valve chamber as formed in the conventional example, neither the problem as to dimensional accuracy nor the trouble of inserting the ball can occur. It is also possible to solve the problems of the ball impacting the rear end of the tip when the tip is subjected to the centrifugal operation for removing bubbles in the ink during manufacture. Since the ribs formed on the tapered pipe portion in the joint are brought into contact with the inner step portion of the mouthpiece, movement of the tip 5 relative to the mouthpiece 2 may be prevented. Accordingly, sway of the tip can be inhibited which results in a more stable feel during writing. Since the augmentation and reduction of pressure inside the barrel due to attachment or removal of the cap can be inhibited so that air bubbles are prevented from flowing into the ink, a smoother writing performance results. Moreover, it is possible to provide a simple means to prevent the tip ball from drying as well as preventing the ink from vaporizing.

As to the centrifugal operation, tips of refills must be abutted against a certain surface in a container of a centrifugal separator; otherwise ink would leak from the tip end to pollute the container. Conventional refills would be entangled with one another when bundled for loading the refills in the container of the centrifugal separator. This would keep some refills at their tips spaced from the abutted surface to thereby pollute the container. In the present invention, since the ribs having linearly or curvingly slanting top surfaces are provided on the joint in such a manner that the ribs are level with the flange outside diameter surface at their adjoining points, no refills are entangled with each other at the joint portions when the refills are bundled for the centrifugal operation in the container of the centrifugal separator. Therefore, tips of the refills can be properly abutted in place so that it is possible to prevent ink from leaking from those tips and therefore it is possible to avoid the pollution of the container.

In addition, since the ball valve is inserted with play in the valve chamber in such a manner that the ball is made eccentric properly to the cavity, no trouble occurs of the ball valve engaging the entrance at the centrifugal separation. It is also possible to prevent ink from flowing backward when writing with the tip oriented upward. Further, since the colored resin piece is immersed in the follower, not only can the exhaustion of ink be clearly seen, but it is also possible, regardless of whether the cap is attached or not, to prevent the back leaking of ink and the disengagement of the tip ball, both caused by falling impact. Moreover, in case an infant accidentally swallowed the cap and the cap stuck in its throat, it is possible to avoid the hazard of choking. In addition, no gap between the tip and the mouthpiece results in a better feel when writing due to the increased stability of the tip.

While the embodiment of the invention shown and described is fully capable of achieving the results desired, it is to be understood that this embodiment has been shown and described for purposes of illustration only and not for purposes of limitation. Other variations in the form and details that occur to those skilled in the art and which are within the spirit and scope of the invention are not specifically addressed. Therefore, the invention is limited only by the appended claims.

What is claimed is:

1. A ballpoint pen equipped with a backflow preventing mechanism, comprising:

a joint comprising:

a valve chamber disposed in an approximately middle portion of said joint with respect to the axial direction thereof for holding a ball valve therein with play, said valve chamber further having a ball valve seat in a rear portion thereof;

a cavity having an entrance disposed in front of said valve chamber; and a conduit disposed in said rear portion of said valve chamber and communicating therewith via said ball valve seat, said joint holding a tip in said cavity and holding an ink reservoir communicating with said conduit; and means which allows said ball valve to fit on said ball valve seat so as to block said conduit when said cavity is oriented upward and which allows said ball valve to be spaced from a wall surface of said valve chamber and be held so as not to block said entrance of said cavity when said cavity is oriented downward, said means constructed such that an axis of path holding said ball valve with play is made eccentric relative to the axis of said entrance wherein a channel is provided on one side of said valve chamber.

2. The ballpoint pen of claim 1, wherein said means which allows said ball valve to be spaced from a wall surface of said valve chamber and be held so as not to block said entrance of said cavity is constructed such that:

the axis of said conduit is made coincident with the axis of said entrance;

a plurality of vertical ribs each having a different height are disposed on the peripheral wall of said valve chamber such that the axis of a cylindrical space defined by top surfaces of said ribs, that is said axis of path holding said ball valve with play, is made eccentric to the axis of said entrance and that channels defined by said ribs are adapted to allow ink to flow when the pen is oriented downward; and a movable valve which has a spherical shape at least on a surface that contacts with the conduit is positioned in said cylindrical space with play.

3. The ballpoint pen of claim 1, wherein said joint is composed of:

a tapered pipe portion as the front part thereof having said cavity and said valve chamber in the axial central portion thereof;

an annular flange at the rear end of said tapered pipe portion;

a fitting pipe portion disposed in the rear of said flange, for receiving at the rear end thereof an ink reservoir and a barrel; and a plurality of vertical ribs, each having at least one of a linearly and curvingly slanting surface, disposed on the periphery of said tapered pipe portion so as to form a tapered shape, said ribs being connected to said flange such that the rear ends of said ribs are substantially level with the outer diameter of said flange; and a mouthpiece for covering said tip is fixed abutting said barrel with a step portion inside said mouthpiece being in contact with said vertical ribs.

4. The ballpoint pen of claim 1, wherein said ink reservoir is filled with a thixotropic ink which presents high viscosity at static state but lowers its viscosity due to the rolling of a ball during writing to provide easy ink flow while a follower which moves following the consumption of ink and has a property preventing ink from vaporizing is provided at the rear end of the ink in said ink reservoir.

5. The ballpoint pen of claim 4, wherein said follower which moves relative to the consumption of ink is greasy and a resin piece having a specific weight substantially equal to that of said follower is immersed in said follower.

6. The ballpoint pen of claim 5, wherein said follower which moves relative to the consumption of ink is of at least one of a transparent and translucent greasy material filled in the rear end of said ink reservoir and a colored resin piece having a specific weight substantially equal to that of said follower is immersed in said follower.

7. The ballpoint pen of claim 3, wherein a ventilating passage from a clearance at a front opening of said mouthpiece between said tip penetrated therethrough and an edge of said front opening is communicated by way of channels defined between said ribs disposed on the peripheral surface of said tapered pipe portion and the inner surface of said mouthpiece and by way of recesses formed at the front barrel end to an inner space inside said barrel; a cap which is fit in and fixed to the front barrel is formed integrally with an inner cap for hermetically covering said tip; a vent connecting from the inserting side to the rear end of the cap is formed between said cap and said inner cap; and said inner cap is further provided with a resilient, non-absorptive sealing piece made of a closed foam material for engaging the exposed end of said tip.

8. The ballpoint pen of claim 1 wherein said conduit disposed in the rear of said valve chamber communicates with said valve chamber in the radially central portion of said ball valve seat.

9. The ballpoint pen of claim 1 wherein said conduit disposed in the rear of said valve chamber communicates with said valve chamber in a portion offset from the radial center of said ball valve seat.

* * * * *